United States Patent [19]

Phipps et al.

[11] Patent Number: 4,494,387

[45] Date of Patent: Jan. 22, 1985

[54] INTERCHANGEABLE KNITTING NEEDLE SYSTEM

[75] Inventors: Cornelius M. Phipps; Cornelius M. Phipps, Jr., both of Glen Ellyn, Ill.

[73] Assignee: Plastic Specialties, Inc., Glen Ellyn, Ill.

[21] Appl. No.: 525,221

[22] Filed: Aug. 22, 1983

[51] Int. Cl.[3] ..... D04B 35/02

[52] U.S. Cl. ..... 66/117

[58] Field of Search ..... 66/116, 117, 118

[56] References Cited

U.S. PATENT DOCUMENTS

| | | | |
|---|---|---|---|
| 2,807,945 | 10/1957 | Carlson | 66/117 |
| 3,280,595 | 10/1966 | Linstead | 66/117 |
| 4,007,610 | 2/1977 | Linstead | 66/117 |

*Primary Examiner*—Ronald Feldbaum

*Attorney, Agent, or Firm*—Lee, Smith & Zickert

[57] ABSTRACT

An interchangeable knitting needle system having knitting needles with engageable, and releasably securing, locking means capable of resilient securement with tube adaptor means. The tube adaptor means capable of engaging ends of yarn storage tubes and being cooperative with said engageable needle locking means for interconnecting the yarn storage tubes between a pair of needles. Further, connector members are provided for linking a plurality of tubes between a pair of knitting needles. The connector members having opposite engaging end means, each being substantially the same as said engageable locking means of said needles, whereby said releasable locking means permit quick engagement and disengagement to enable interchanging or rearranging the components of the system.

6 Claims, 8 Drawing Figures

INTERCHANGEABLE KNITTING NEEDLE SYSTEM

BACKGROUND AND SUMMARY OF THE INVENTION

The invention generally relates to knitting, and particularly to that form of knitting wherein looped yarn is gathered along a connector extending from the lower end of one needle, or interconnecting the lower ends of two needles, such as used in a circular knitting procedure.

In knitting certain patterns for clothing, and for a variety of knitted craftwork, the looped yarn slides down the needle and is received along a cord or string attached to the end of the needle. When knitting circular garments, such as the sleeves of a sweater, the other end of the cord is similarly affixed to a second knitting needle. Thus, upon completing the necessary width of material the final two stitches may be interengaged forming the enclosing shape.

In certain craftwork, a cord depending from only one knitting needle is utilized and the opposite end of the cord has a stopper rather than being affixed to a second needle.

Some earlier devices were constructed integrally with an intermediate loop whereby the needles were not removable. However, use of plastic nylon flexible interconnecting means have allowed the detachment of one or both needles, so that the needles can be disconnected and used individually. Nylon and other plastic connectors are presently used for attachment of hollow tubes between two knitting needles. The constant irritation to craftspeople in utilizing these connected tubes is that they tend to become disengaged during knitting procedures. This is probably caused by the rotation and twisting movement of the user while looping the yarn and forming the stitches.

The present invention is therefore directed to providing an interchangeable knitting needle system wherein needles are provided with free ends formed in a conventional manner, and terminating at the opposite ends in a unique engageable construction. The engageable ends are securely connectible to tube adaptors, which can firmly engage the ends of interconnecting tubes. A unique locking means at mating portions of the adaptors and needle ends securely hold them together when needed but can be disengaged at the discretion of the user. An additional feature of the invention is the provision for stringing a plurality of tubes together by the utilization of a double-ended connector having a locking structure as found at the ends of the needles, but provided at opposite connector ends to enable the linking of one tube to another between a pair of needles. A stop button is also provided and is formed with a similar locking means whereby a single needle may be connected to one end of a tube, while the other end of the tube is engaged to the stop button by means of an adaptor. The stop button is preferably disc-shaped and of a sufficient diameter to prevent accumulated stitches from sliding off the tube.

It is therefore a primary object of the invention to provide an interengageable knitting needle system whereby tubes may interconnect needles in a locked, but selectively disengageable, fashion during use.

It is another goal of the invention to provide adaptors capable of engaging flexible plastic tubes and having means for releasably locking to engageable ends of the knitting needles.

It is a further object of the invention to provide a stop button having a unique locking means capable of securement at the end of a tube by means of an adaptor secured therein, whereby a first knitting needle is connected at the opposite end of the tube for storage of stitched yarn therealong, and a second needle has both ends free.

It is further an object of the invention to provide a knitting needle having a conventional pointed tip at a end of a central shaft and, at the opposite end, a tapered locking end which reduces to a diameter substantially the same as the body of an adaptor, whereby stitches may slide down the central shaft of the knitting needle, over the tapered end and adaptor, to be collected along a connector tube.

It is accordingly a concomitant goal of the invention to utilize thin tubes of a diameter substantially less than the central shaft of the knitting needle to accommodate very tightly drawn stitches.

It is another object of the invention to provide a tube adaptor having a body and a thread-engageable counterbore opening at an end face thereof, wherein said end face includes spaced-apart radial seats capable of receiving bosses located on the end face of a needle, or at end faces of double-ended connectors, whereby said bosses and seats engage to effectively prevent unintended rotational disengagement of the adaptor to the abutted engaging member.

DESCRIPTION OF EXAMPLE BEST EMBODYING THE INVENTION

With reference to the drawings, it will be seen that the interchangeable knitting needle system comprises, in preferred form: at least one pair of substantially identical knitting needles; one or more plastic tubes for connecting the needles together; a stop button; a double-ended connector; and, adaptors capable of tube engagement at one side and having, at the opposite side, locking engageable means for securement with a needle, a stop button, or a double-ended connector.

Figure 1:
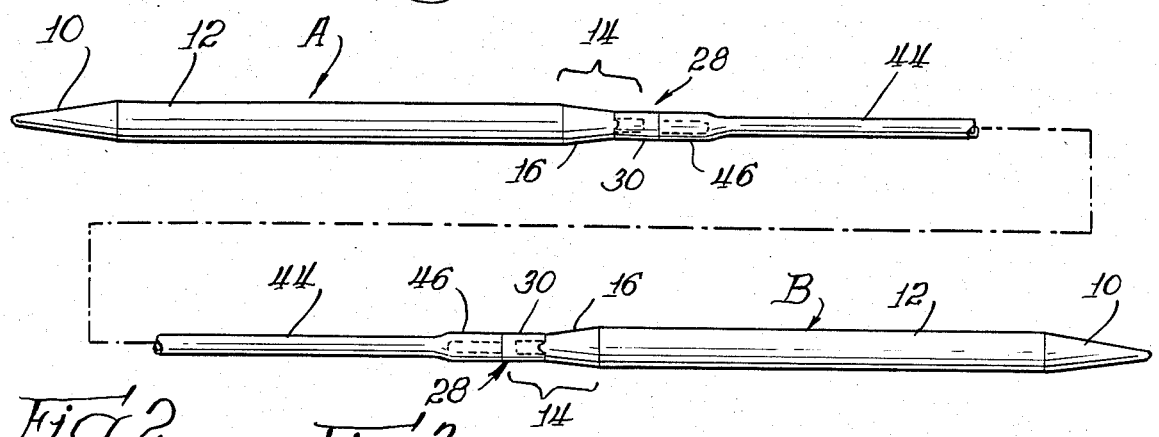
FIG. 1 is a plan view of two substantially identical knitting needles in accordance with the invention wherein the needles are interconnected by a flexible tube, shown in dashed lines, by means of adaptors secured at opposite ends of the tube.

With particular reference now made to FIG. 1, a pair of substantially identical knitting needles A and B are provided with conventional conical-shaped first, or free, ends 10 for looping yarn to form stitches. A central shaft portion 12 extends from the free end to an engageable end 14.

Figure 5:
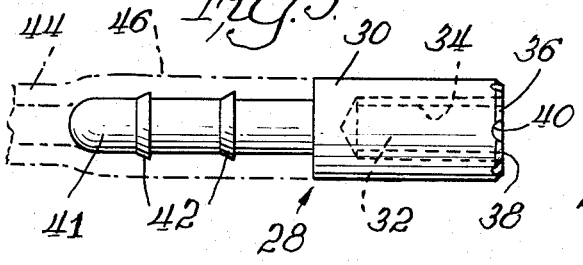
FIG. 5 is a plan view of a tube adaptor as shown in FIG. 1 capable for engagement to the end of a tube at one side thereof and at the other side being engageable with a stop button, a needle or a connector, as shown in the Figures.
Figure 6:
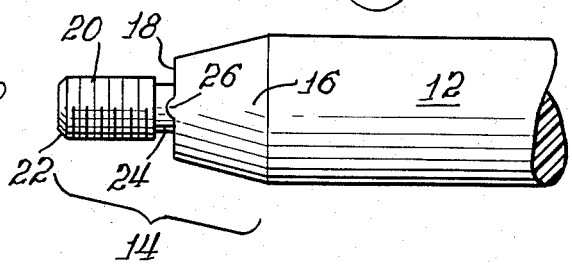
FIG. 6 is a plan view of an engageable end portion of one of the knitting needles as shown in FIG. 1 and being capable of engagement with the adaptor of FIG. 5.
Figure 7:
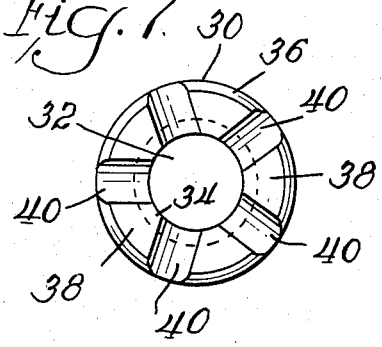
FIG. 7 is an end view of the adaptor as shown in FIG. 5, which provides locking means for securement with mating locking means of a stop button, a double-ended connector, or a knitting needle, as shown in the Figures.
Figure 8:
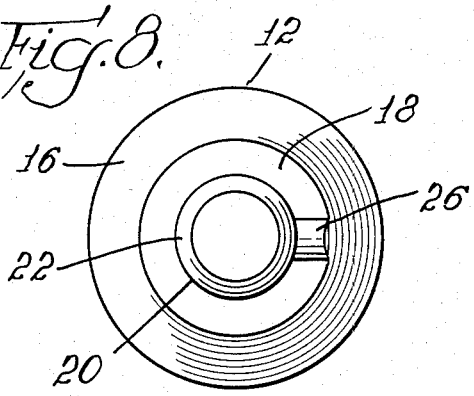
FIG. 8 is an end view of the engageable end portion of the knitting needle shown in FIG. 6, which provides releasable locking means for securement with the locking means of the tube adaptor as shown in FIG. 7.

The locking operation of engageable ends 14 will be understood with reference to FIG. 6 where it is seen that shaft 12 tapers at portion 16 and terminates at an end face 18. An axial threaded shaft 20 extends from face 18 and terminates in a conventional bevel 22. Adjacent face 18, shaft 20 is undercut at 24. Undercut 24 provides relief in a known manner and permits end face 18 to snugly abut a complementary adaptor face, as will be described. End face 18 is ring shaped, as best viewed in FIG. 8, and includes a raised radially extending boss 26, which is radiused. Engageable end 14 is engageable with the tube adaptor 28, as shown in FIGS. 5 and 7.

Tube adaptor 28 comprises a generally cylindrical body 30 having a concentric axial counterbore 32 opening at one face of body 30 and having internal threading 34. Internal threading 34 is thread engageable with threaded shaft 20 of knitting needles A, B. Body 30 is circumferentially beveled at 36 which forms the border of end face 38. A plurality of equally spaced radial seats 40 extend across face 38 between counterbore 32 and bevel 36. Radial seats 40 have radiused depths substantially the same dimension as the height of bosses 26 for receipt thereof upon full thread engagement to lock the two engaging parts together.

At the opposite end of body 30 an axially projecting finger 41 extends longitudinally therefrom and is adapted for insertion within a tube 44. Finger 41 is provided with a plurality of flanges 42 which are beveled to act as barb-type catches along the interior walls of tubes 44. In phantom, FIG. 5 additionally shows the insertion of finger 41 within the end of tube 44. The flanges 42 have slightly larger outside diameters than the internal diameter of tube 44 and cause the tubes to flare at 46 when inserted to securely hold adaptor 28 to a tube.

It will be appreciated that, in order to offer a smooth traveling surface for stitches, the shaft 12 of needles A, B are tapered at 16 and reduce to a diameter equal to that of body 30. The internal and external diameters of tube 44 provide a wall thickness whereby the insertion of finger 41 causes flare 46 to resiliently expand to about the same diameter as body 30 and the terminus diameter of taper 16.

The diameter of shaft 12 is of a conventional dimension and permits the craftworker to comfortably and skillfully manipulate the needles A, B, while tubes 44 are small enough to desirably accommodate tightly drawn stitches. In the example shown, shaft 12 has a diameter of 0.260 inches and taper 16 is formed with a 15 degree slope to reduce the section to a diameter of 0.150 inches. The external diameter at beveled flanges 42 is 0.090 inches. The wall thickness of tube 44 is about 0.031 inches.

Figure 2:
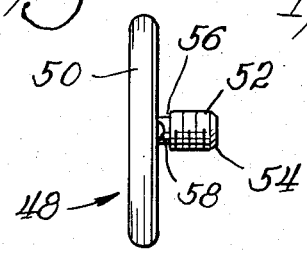
FIG. 2 is a side view of a stop button, which may be interchanged with one of the knitting needles shown in FIG. 1.
Figure 3:
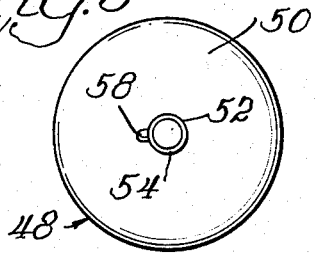
FIG. 3 is a front view of the stop button as shown in FIG. 2.

Adaptor 28 can also engage a stop button 48, shown in FIGS. 2 and 3, whereby a single needle is connected to tube 44 and stop button 48 is secured to an adaptor 28 at the other end of the tube. This arrangement is also useful for gathering stitches along tube 44 but permits a second knitting needle to be freely maneuverable.

With more particular reference to FIGS. 2 and 3, it will be seen that stop button 48 has a disc like portion 50 having a centrally located, and axially extending, threaded shaft 52. Shaft 52 terminates in beveled edges 54 and can be screwed into the internal threading 34 of adaptor 28. Adjacent disc 50, threaded shaft 52 is provided with an undercut 56 for relief, as is conventionally provided in screw fastening. A raised boss 58 is provided along disc 50 in substantially the same manner as boss 26 of engageable end 14. Thereby, boss 58 can be securely engaged in one of the radial seats 40 when the stop botton is screwed tightly into adaptor 28. This permits a releasably locked positioning of a stop button with the end of tube 44 during use, whereby the knitting motions of the user will not accidentally loosen the stop button and permit the yarn to slip off tube 44.

Figure 4:
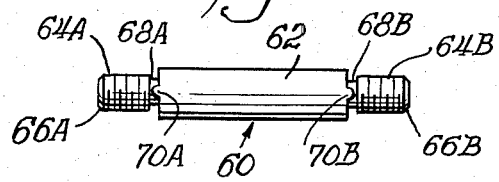
FIG. 4 is a plan view of a double-ended connector in accordance with the invention and being capable of stringing a plurality of tubes together and having, at opposite ends thereof, engageable portions for locking securement to tube adaptors.

Different craft projects can involve gathering a wide variety of knot lengths. To meet this need, provision is made for linking a plurality of tubes 44, thus affording a considerable advantage to the user for making different-sized projects. It is envisioned that the system include a plurality of equal length tubes which may be linked to attain the desired length. Thus, rather than requiring various lengths, a standard tube length of about 12 inches to about 24 inches is contemplated. With reference to FIG. 4, it will be seen that a double-ended connector 60 is provided and has substantially identical engageable ends extending from a body 62. Body 62 is cylindrical and terminates at opposite ends in axially projecting threaded shafts 64A, 64B, which are capable of engaging the counterbores 32 of adaptors 28. Threaded shafts 64A, 64B include end bevels 66A, 66B, as in conventional threading design. Undercuts 68A, 68B, of the base of the shafts, are provided for relief. At the opposite end faces of body 62, radiused bosses 70A, 70B are provided for locking securement within radial seats 40 of adaptors 28 at both ends of the connector.

In practice, a plurality of tubes 44 can be linked by inserting adaptors 28 (FIG. 5) at both ends of each tube, and then engaging double-ended connectors 60 with all but one pair of adaptors. The last pair of the linked tubes 44 are then each connected to a needle end 14, as shown in FIG. 1, with the understanding that the plurality of tubes 44 would extend along the dashed line interconnecting needles A, B.

To facilitate a releasable locking between the bosses 26, 58, 70A, 70B and the radial seats 40, it is preferable that needles A, B, adaptor 28, stop button 48, and double-ended connector 60, are made of a resilient but durable material. One particular material envisioned is Type 6 nylon or equivalent. The insertability of adaptor 28 is best served by using tubes 14 of PVC plastic which material is capable of elastically expanding to flare at 46 upon entrance of finger 40 and beveled flanges 42.

For certain knitting projects, thin needles may be required. Accordingly, needles A and B having a diameter as small as the outside diameter of adaptor 28 may be used. With the smallest size, a transition or taper 16 would not be required. Since the diameter of adaptor body 30 would be the same diameter as shaft 12 and a smooth travel of looped yarn from shaft 12, over body 30, and onto the tube 44 would be achieved.

It will also be appreciated that a smooth pathway for traveling yarn from the conical tips 10 downwardly onto tube 44 is also ensured by the flush secure contact of needle end faces 18 with adaptor faces 38. This securement is accomplished by the relief action of undercuts 24 and the tight locking of a boss 26 within a radial seat 40 upon full thread engagement. Similarly, the opposite transverse end faces 62 of double-ended connector 60 flushly abut surfaces 38 of adaptor 28. Since stop button 48 is disposed at the end of the tube and gathering stitches do not travel past, flush contact with an adaptor 28 is not critical. It is, however, important that the stop button remain secure in order to retain looped yarn along the tube. Therefore, a snug fitting action is made possible by boss 58 resiliently engaging in a radial seat 40 in substantially the identical fashion as between a connector and an adaptor, or between a needle and an adaptor.

The unique locking means for components of the system makes the components quickly interchangeable and capable of being arranged in a variety of ways.

ACHIEVEMENTS

The invention provides a fully interchangeable knitting system having knitting needles (A, B) with unique engageable ends (14) that internally thread-engage with adaptors (28) for secure connection to an interconnecting tube (44) or plurality of tubes. The tube is hollow and the adaptors are provided with fingers (41) having barb-type annular flanges (42) for insertable attachment to the tube (44). A series of tubes (44) may be sequentially connected to vary the yarn storage capacity between the needles by means of double-ended connectors (60). When a particular knitting procedure requires collecting knots in a non-circular fashion, the invention provides for securely fastening a stop button (48) to an adaptor at the end of a tube (44), in a substantially identical fashion to the connection of double-ended connector (60), or needle (A, B).

What is claimed is:

1. An interchangeable knitting needle system comprising at least one knitting needle having a tip, central shaft, and an opposite thread-engageable end including a resilient locking means capable of releasable securement with a tube adaptor, said tube adaptor having means for securing the locking means of the needle engageable end and further having at the opposite end thereof insertable tube engaging means, and at least one flexible tube.

2. An interchangeable knitting needle system as claimed in claim 1 wherein said system includes a double-ended connector having a central body portion and opposite thread engageable ends including locking means capable of resilient and releasable securement with said tube adaptor.

3. An interchangeable knitting needle system as claimed in claim 1 wherein said system includes a first knitting needle having its engageable end secured to an adaptor, said adaptor being secured interiorly of one end of a tube, at the opposite tube end a second adaptor being secured thereto, and a second knitting needle secured to the second adaptor, thereby forming means for storing stitches of yarn between said knitting needles.

4. An interchangeable knitting needle system as claimed in claim 1 wherein a plurality of tubes extend between two knitting needles, the tubes having said tube adaptors engaged at ends thereof, and double-ended connector means releasably secured to all but one pair of tube adaptors, wherein said two knitting needles are each releasably secured to a tube adaptor.

5. An interchangeable knitting needle system as claimed in claim 1 wherein said tube is secured to tube adaptors at both ends thereof, one said tube adaptor releasably secured to a stop button having resilient locking means, and the other tube adaptor being releasably secured to the thread engageable end of said knitting needle.

6. An interchangeable knitting needle system as claimed in claim 1 wherein said central shaft tapers to said engageable needle end to form a terminal diameter substantially the same as the diameter of a body portion of the adaptor and wherein upon insertion of the insertable tube engaging means of the adaptor into said tube, said tube flares to form a diameter substantially the same as said adaptor body portion.

* * * * *

UNITED STATES PATENT AND TRADEMARK OFFICE

CERTIFICATE OF CORRECTION

PATENT NO. : 4,494,387

DATED : January 22, 1985

INVENTOR(S) : Cornelius M. Phipps et al.

It is certified that error appears in the above-identified patent and that said Letters Patent are hereby corrected as shown below:

Column 2, line 12, immediately before the first word "end", please insert the word --free--.

Signed and Sealed this

*Fourteenth* Day of *May 1985*

[SEAL]

*Attest:*

DONALD J. QUIGG

*Attesting Officer* *Acting Commissioner of Patents and Trademarks*